US011145279B2

(12) United States Patent
Planet Ylla

(10) Patent No.: US 11,145,279 B2
(45) Date of Patent: Oct. 12, 2021

(54) STRING INSTRUMENT FORMED AS AN INTEGRAL UNIT STRUCTURE

(71) Applicant: Ramon Planet Ylla, Sant Joan de Vilatorrada (ES)

(72) Inventor: Ramon Planet Ylla, Sant Joan de Vilatorrada (ES)

( * ) Notice: Subject to any disclaimer, the term of this patent is extended or adjusted under 35 U.S.C. 154(b) by 0 days.

(21) Appl. No.: 16/651,681

(22) PCT Filed: Oct. 4, 2018

(86) PCT No.: PCT/ES2018/070642
§ 371 (c)(1),
(2) Date: Mar. 27, 2020

(87) PCT Pub. No.: WO2019/068953
PCT Pub. Date: Apr. 11, 2019

(65) Prior Publication Data

US 2020/0265810 A1 Aug. 20, 2020

(30) Foreign Application Priority Data

Oct. 6, 2017 (ES) ..... P201731183

(51) Int. Cl.
*G10D 1/08* (2006.01)
*G10D 3/22* (2020.01)
(Continued)

(52) U.S. Cl.
CPC ..... *G10D 1/085* (2013.01); *F21V 33/0056* (2013.01); *G10D 3/06* (2013.01);
(Continued)

(58) Field of Classification Search
CPC ..... G10D 1/085; G10D 3/22; G10D 3/06; G10D 1/00; F21V 33/0056; G10H 3/18;
(Continued)

(56) References Cited

U.S. PATENT DOCUMENTS 4,359,923 A * 11/1982 Brunet ..... G10D 3/02 84/267
6,191,348 B1 2/2001 Johnson
(Continued)

FOREIGN PATENT DOCUMENTS

GB 2037049 A 7/1980

OTHER PUBLICATIONS

International Search Report and Written Opinion dated Feb. 13, 2019 in corresponding International Application No. PCT/ES2018/070642; 18 pages.
(Continued)

*Primary Examiner* — Jeffrey Donels
(74) *Attorney, Agent, or Firm* — Maier & Maier, PLLC

(57) ABSTRACT

Stringed musical instrument including a unitary structure formed integrally by a body, a neck and a head from a solid block of non-wood rigid material by computer numerical control (CNC) machining, with the pegs, the bridge, the fingerboard and the strings mounted on said unitary structure, front panels and rear panels that seal said body and a fingerboard machined by CNC as a single piece and connected to said unitary structure in a removable and interchangeable manner.

13 Claims, 6 Drawing Sheets

(51) Int. Cl.

| | |
|---|---|
| ***F21V 33/00*** | (2006.01) |
| ***G10D 3/06*** | (2020.01) |
| ***G10H 3/18*** | (2006.01) |
| ***F21Y 115/10*** | (2016.01) |

(52) U.S. Cl.
CPC ..... *G10D 3/22* (2020.02); *G10H 3/18* (2013.01); *F21Y 2115/10* (2016.08); *G10H 2220/096* (2013.01); *G10H 2220/461* (2013.01)

(58) Field of Classification Search
CPC ..... G10H 2220/096; G10H 2220/461; F21Y 2115/10; B29D 17/00
See application file for complete search history.

(56) References Cited

U.S. PATENT DOCUMENTS

| | | | | |
|---|---|---|---|---|
| 6,233,825 | B1 * | 5/2001 | DeGroot | G10D 1/085 29/896.22 |
| 6,255,566 | B1 * | 7/2001 | Bly | G10D 1/085 84/267 |
| 6,255,567 | B1 * | 7/2001 | Minakuchi | G10D 1/085 84/291 |
| 8,324,489 | B1 | 12/2012 | Chapman | |
| 8,829,318 | B1 * | 9/2014 | DeLaFrance | G10H 1/32 84/292 |
| 2002/0104423 | A1 * | 8/2002 | Verd | G10D 3/22 84/291 |
| 2003/0019349 | A1 * | 1/2003 | Green | G10H 3/18 84/731 |
| 2009/0126553 | A1 | 5/2009 | Murray | |
| 2013/0174709 | A1 * | 7/2013 | DeLong | G10D 1/085 84/267 |
| 2013/0340591 | A1 | 12/2013 | Koszegfalvi | |
| 2014/0260887 | A1 | 9/2014 | Fletcher | |
| 2014/0345441 | A1 * | 11/2014 | Ostosh | G10D 1/085 84/723 |

OTHER PUBLICATIONS

Anonymous: "Aluminium Guitar—CNC machined", Immetech Industrial Co., Ltd; Junyi Metal & Plastic Mold Co, Ltd, Jan. 1, 2007, URL:http://www.junyimould.com/dispro.asp?id=17, Retrieved Feb. 6, 2019, 1 page.

Daishin Seiki Ryosuke Omachi: "CNC The Machine Cutting Premium Guitar", Youtube Jun. 21, 2011, URL: https://www.youtube.cm/watch?v=reBPyJeyPac; (Submittig 4 pages of screenshots).

* cited by examiner

STRING INSTRUMENT FORMED AS AN INTEGRAL UNIT STRUCTURE

FIELD

The present invention relates generally to stringed musical instruments. The present invention relates more particularly to a stringed musical instrument manufactured integrally from a solid block of rigid non-wood material, by computer numerical control (CNC), obtaining an instrument that offers advantageous structural features of simplicity and functionality.

BACKGROUND

Traditionally, stringed instruments have been constructed from wood, but they have also been made from other materials such as plastics, molded compounds and combinations of such materials. These materials are imperfect and irreplicable for reasons inherent to their organicity and structure. Thus, they are easily deformable by exposure to use, temperature changes, erosion, structural stresses and are, consequently, unable to offer a correct and permanent stability/reliability and provide an adequate and equal sound over time or even between products of the same manufacturer and model giving rise to defects and undesirable tonal variations. These disadvantages have led to the use of alternative construction materials, such as metallic materials.

On the other hand, in many conventional stringed instruments, the various components are constructed separately, and then connected to form a finished instrument. Since the tonal quality depends to a large extent on the structural integrity of the instrument, there is inevitably some loss of quality due to the fact that several parts of the instrument, although permanently mounted, are actually separate pieces.

The construction of a unitary guitar formed integrally from metal casting is known from U.S. Pat. No. 4,359,923. Although it is a unitary metal structure, the pieces made from metal casting, besides resulting in inaccurate instruments, may suffer density variations causing the sine wave that creates the vibration of the strings to be altered and affected by the material through which it is intended to propagate.

In a stringed instrument like a guitar there are certain distances that are derived from Pythagorean scales and highly precise mathematical calculations that need to be replicated perfectly to obtain adequate settings, without which an instrument can never come to provide a correct sound. The advent of CNC machining has allowed for the construction of high precision instruments.

U.S. Pat. Nos. 6,233,825 and 8,829,318 describe Metal guitar bodies manufactured by CNC are known from U.S. Pat. Nos. 6,233,825 and 8,829,318.

On the other hand, in conventional musical instruments the metal frets of the fretboard are inserted individually into transverse grooves or channels configured on the front side of the fretboard by friction-adjustment or additionally secured by glue. This is a costly operation, which requires a high level of skill and experience on the part of a luthier, becoming a tedious process of trial and error before reaching a satisfactory result. A metal fretboard manufactured integrally and unitary by means of CNC is known from U.S. Pat. No. 8,324,489.

The fact of being able to have a metal fingerboard manufactured as a unitary piece is a clear advance in the state of the art, although the fingerboard-neck combination is still a limiting aspect since the degree of curvature of the fingerboard is a critical aspect that affects the sound of the instrument and to date it has not been contemplated the possibility of having interchangeable fingerboards with different compound radios for the same instrument.

It is a main object of the present invention to provide a novel and improved construction for a guitar, or a similar stringed instrument formed as an integral unitary structure, having superior sound qualities by improving the sustain of the musical waves through it.

It is another object to provide a high precision electric stringed musical instrument that allows a substantially accurate duplication from instrument to instrument.

It is an additional object to provide a stringed musical instrument that presents a significant reduction in production times.

It is still another object to provide an instrument equipped with a metal fingerboard manufactured by CNC wherein all the frets are integrally formed with said fingerboard and is specifically designed to adapt to said instrument, being easily removable and replaceable by others of different radii, simple or compounds (between its two extremes), and fret positioning, which can also be dispensed with, giving the instrument great versatility. In this way, the possibility of having different fingerboards with different types of curvature allows to obtain different feelings when playing the same instrument.

For all these reasons, the stringed instrument obtained results from very advantageous features with respect to the conventional embodiments of known stringed musical instruments.

SUMMARY

In order to achieve the objectives and avoid the drawbacks mentioned in the previous section, the present invention contemplates the construction of a stringed musical instrument in which all the main portions, including body, neck and head are formed as an integral unitary structure, of non-wood rigid material, preferably aluminum. The raw material provides unbeatable qualities in relation to the sustain of musical waves through it.

The stringed instrument of the present invention is made by computer numerical control (CNC) from CAD/CAM designs ensuring that the measures necessary for the correct operation of the instrument are calculated with a tolerance of error of the thousandth.

The stringed instrument of the present invention has cavities and/or housings some of which are internally communicated by openings arranged in the side walls of the same forming an interconnected network that allows to control the resonance and sustain within the structure of the body formed integrally. Said interconnected network of cavities and/or housings, added to the unitary structure of the neck and the body, provide a longer sustain creating an effect of "infinite sustain".

Characteristically, the fingerboard and the bridge are also machined in a single metal piece, offering the possibility of having easily interchangeable fingerboard-bridge assemblies and having fingerboards with different radii, simple or compound (between their two ends), and positioning of frets, which can also be dispensed with, for the same stringed instrument. On the other hand, the fingerboard of the present invention is provided with connection means that allow the fingerboard to be connected laterally, providing a front surface of the fingerboard free from unwanted obstacles (for example, screws).

With this invention, periodic revisions by a luthier are not required since the design is based on a structure designed to withstand stresses much higher than those usually exposed to and, its hardness/rigidity/elasticity coefficient, ensures a constant permanence of the necessary measures and set-up fittings between the body of the guitar and the sting supports over time and use, ensuring the non-deformation of the instrument itself and therefore the permanence of the initial adjustments.

BRIEF DESCRIPTION OF THE DRAWINGS

To complement the description that is being made and in order to facilitate the understanding of the characteristics of the invention, a set of drawings in which, with an illustrative and non-limiting character, the following has been represented is attached to the present specification.

DETAILED DESCRIPTION

For descriptive purposes, the invention relates to the construction of an electric guitar, without this limiting the scope of the invention, since it can be applied to any stringed musical instrument.

Figure 1:
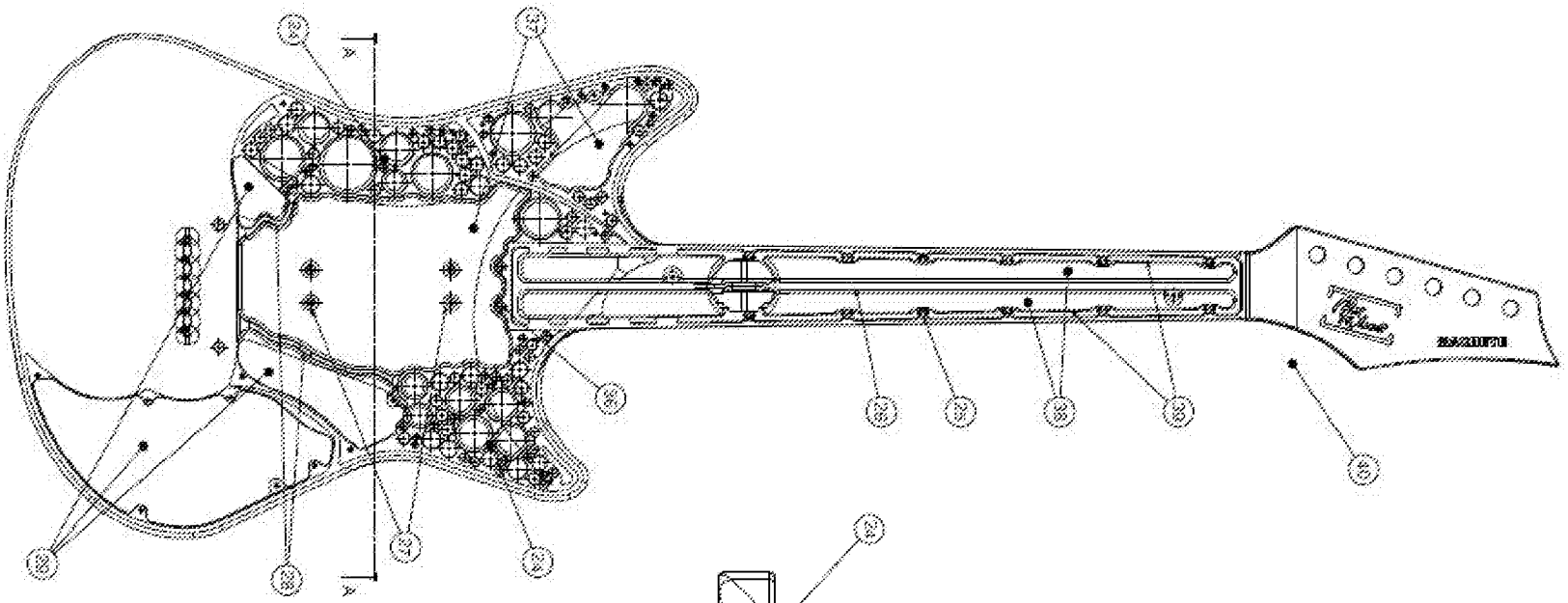
FIG. 1 shows a front elevation view of an embodiment of the unitary structure of the invention.
Figure 2:
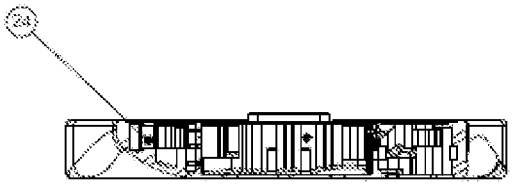
FIG. 2 shows a front elevation view of another embodiment of the unitary structure of the invention.
Figure 3:
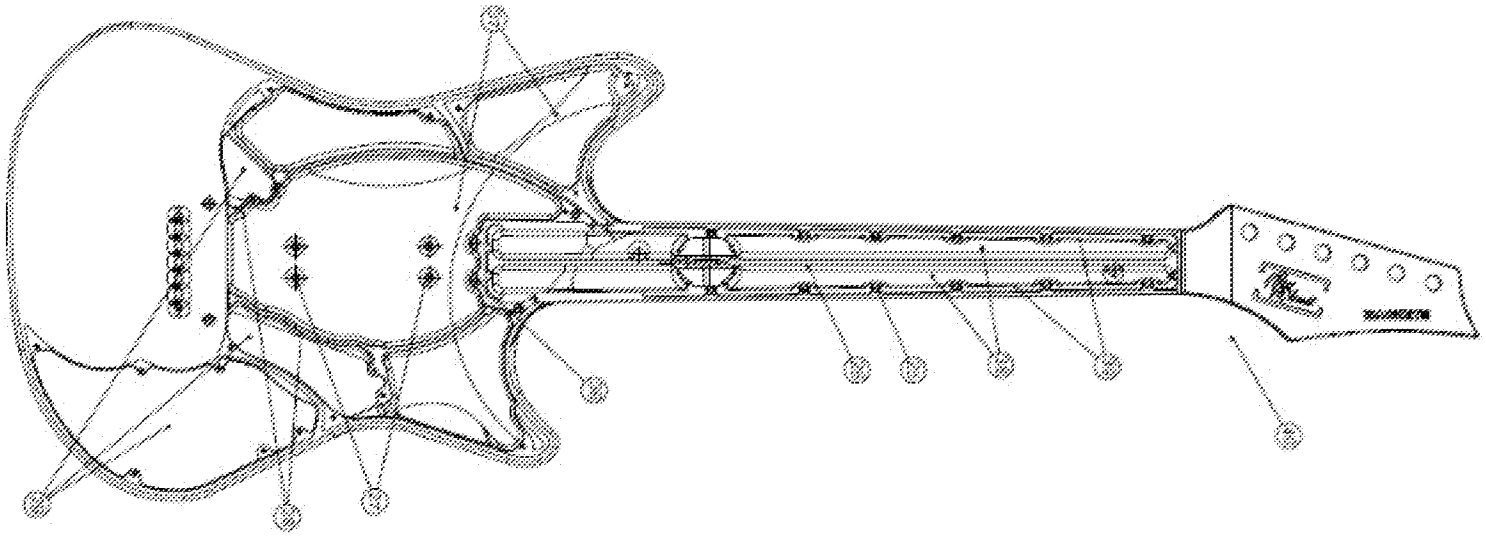
FIG. 3 shows a cross-sectional view of FIG. 1.
Figure 4:
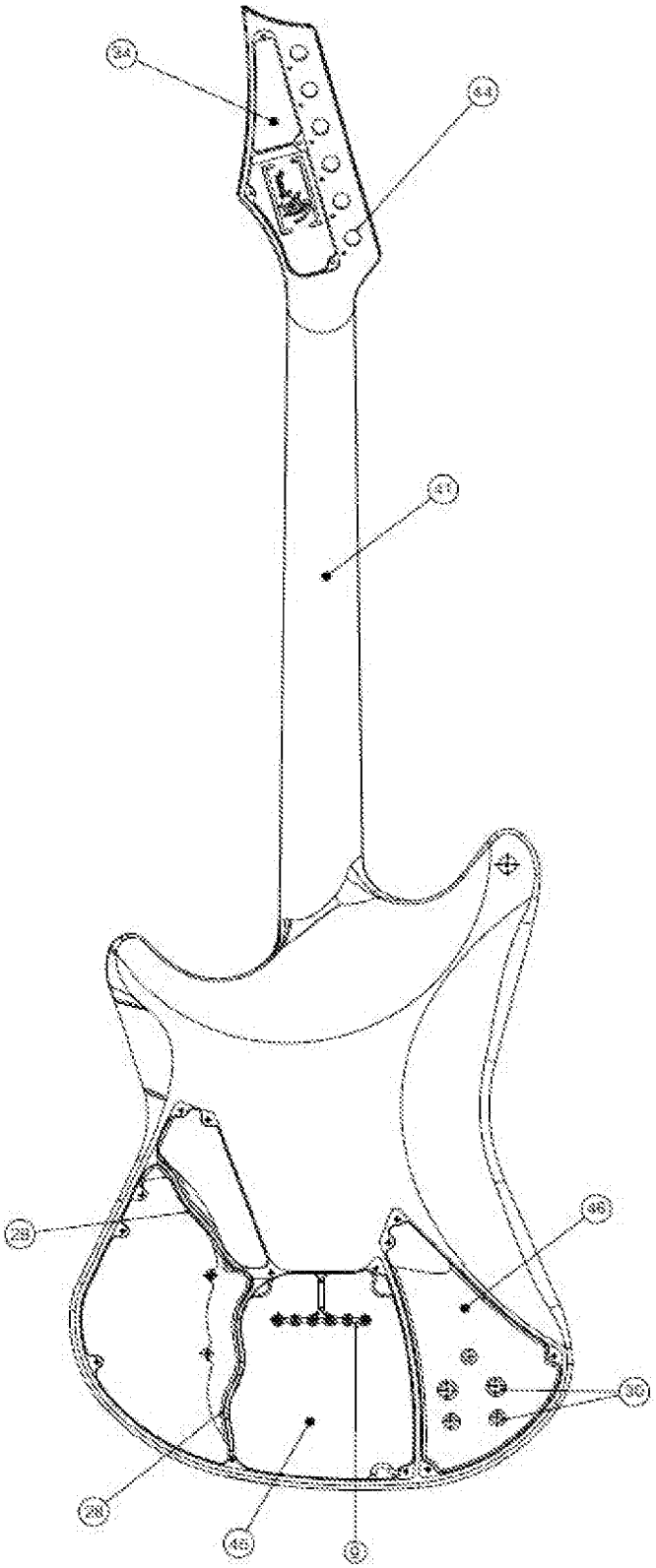
FIG. 4 shows a rear elevation view of an embodiment of the unitary structure of the invention.

As shown in FIGS. 1, 3 and 4, the unitary structure (40) incorporates all the basic elements of a guitar or similar instrument; including body (15), neck (41) and head (17), minus the strings, the tuning pegs, the fingerboard, the bridge and any desired electronic means.

The body (15) of the guitar preferably comprises a distinctive pattern of cavities (24) and/or housings (37) in its front part (43) placed in predetermined locations and intervals and open chambers (29) extending between said front part and the rear part (42). This preferred arrangement reduces the total body weight while maintaining the required structural strength.

At least some of said cavities (24) and/or housings (37) are communicated internally by openings arranged in the side walls thereof forming an interconnected network that allows to control the resonance and sustain within the structure of the integrally formed body.

The open chambers (29) are delimited by at least some internal ribs (28).

The body (15) further comprises projections (27) in one of the housings (37) for the mounting of pickups (5).

The neck (41) is formed as an open frame including hollow cavities in its front part delimited by a side wall (39), a bottom wall (38) and a central rib (26). It is contemplated that said cavities may accommodate optical fibers or resins connected to light emitting diodes (LEDs), visible through one or more light ports (3,47) located on the front of the fingerboard (2).

The neck is provided with fixing means (25, 36) for fixing the fingerboard (2).

The head (17) is provided with holes (44) for mounting tuners (19) with their corresponding pegs.

Additionally, it is contemplated that the optical fibers or resins extend to a housing (34) located on the back of the head (41), which in turn serves to reduce the weight of the instrument, and are visible through a light port (1) located on the front thereon. The housing (34) is sealed by a back cover (18).

In another embodiment, it is contemplated that the front part (43) of the instrument includes a touch screen.

FIG. 3 shows the back of the guitar including a housing (45) for housing the structure of a tail piece (9), the latter included integrally in said body (15), and a housing (46) equipped with supports (30) that are an integral part of the unitary structure and are intended to support a power source.

FIG. 4 shows the unitary structure (40) with front panels (13A, 13B, 13C) that frontally seal the body (15) and are connected to said body through connection means (14). The front part (43) includes a bridge (6) also manufactured by CNC, preferably in aluminum, pickups (5) mounted on one of the front panels (13B) and supported by the projections (27) and electronic means (10, 11 and 12) mounted on one of the front panels (13C).

Figure 5:
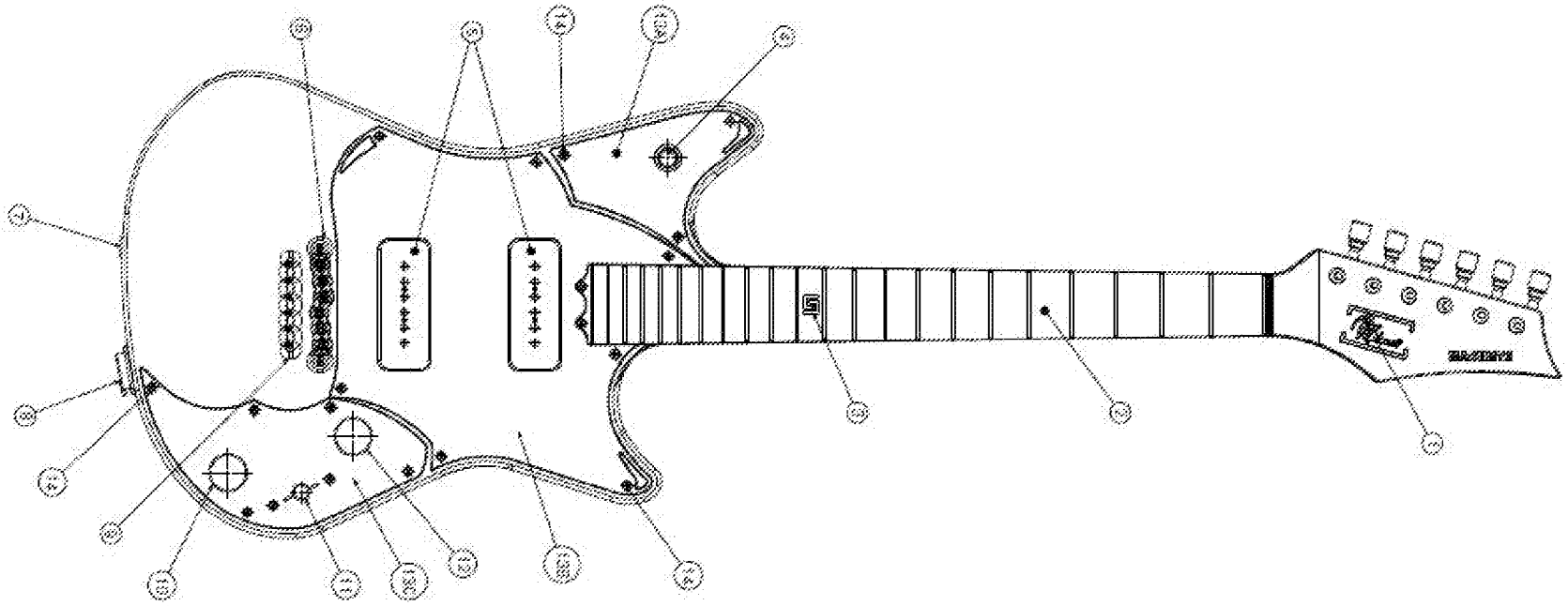
FIG. 5 shows a front elevation view of an embodiment of the invention.
Figure 6:
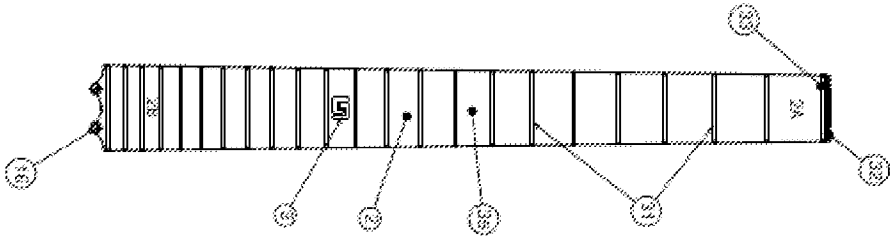
FIG. 6 shows a front elevation view of an embodiment of the fingerboard.
Figure 7:
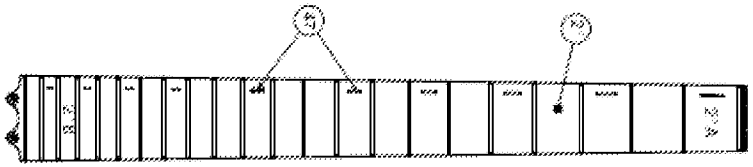
FIG. 7 shows a front elevation view of another embodiment of the fingerboard.

FIGS. 5 and 6 show a front view of two embodiments of the fingerboard (2, 2'). Said fingerboard includes a front surface (35) with a compound radius (2A-2B, 2'A-2'B) that offers multiple possible combinations, an associated set of frets (31) integrally configured with said front surface and comprising a zero-fret (33) and a zero-fret guide (32). Additionally, the fingerboard (2, 2') is provided with connection means (16, 25) for the removable connection of the fingerboard to the neck (41).

In an alternative embodiment, it is contemplated that the fingerboard-neck connection be made by magnet-type connection means.

Figure 8:
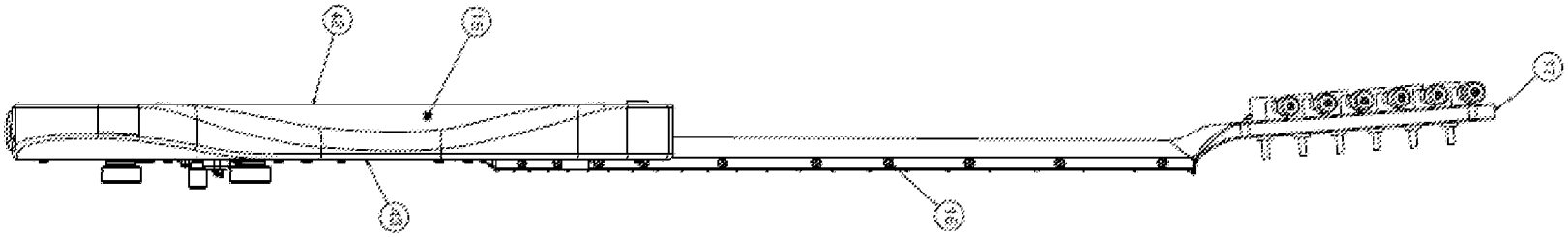
FIG. 8 shows a profile view of an embodiment of the invention.
Figure 9:
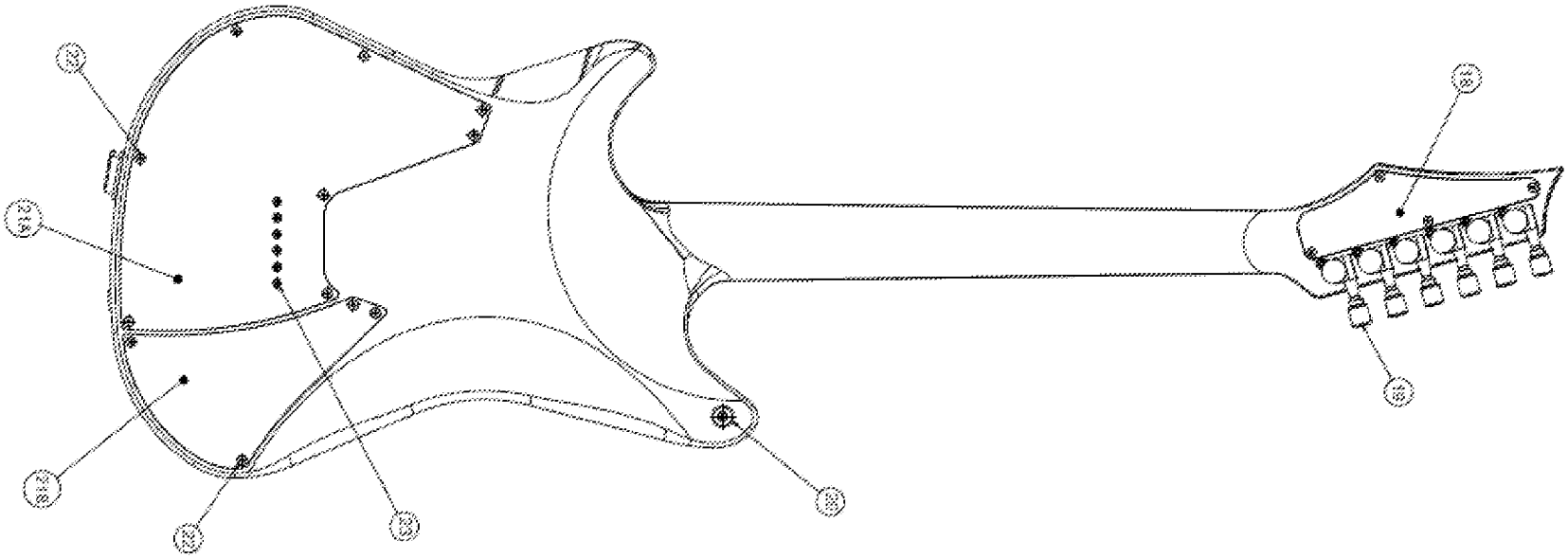
FIG. 9 shows a rear elevation view of an embodiment of the invention.

FIG. 8 shows a rear view of the instrument with rear panels (21A, 21B) which subsequently seal the body (15) and are connected to said body through connection means (22).

In an alternative embodiment, it is contemplated that the connection means (14, 22) of the front and/or rear panels is made by magnet-type connection means.

The structure formed integrally is produced from a solid block of non-wood material by computer numerical control (CNC) that allows the production of structures of high precision and quality.

The fingerboard is manufactured with the frets mechanized under CNC integrally with the rest of the structure of the fingerboard from a single block of rigid material, preferably aluminum.

Once the nature of the invention has been sufficiently described, as well as some examples of preferred embodiments, it is stated for the appropriate purposes that the materials, form, and size of the elements described may be modified, provided that this does not involve an alteration of the essential features of the invention that are claimed below.

The invention claimed is:

1. A stringed musical instrument, comprising:

a unitary structure formed integrally by a body, a neck and a head;

front panels that seal the body at the front, the front panels provided with connection means to connect the panel to said body; and rear panels that seal the body at the back, the rear panels provided with connection means to connect the panel to said body;

wherein:

the unitary structure is formed from a solid block of rigid non-wood material by computer numerical control (CNC) machining;

the body includes a front part with a plurality of cavities and housings arranged at predetermined locations and intervals, at least some of said cavities and housings being communicated internally by openings arranged at the side walls thereof to form an interconnected network; a rear part with housings for the housing of the structure of a tail piece that is integrally comprised in said unitary structure and of a power source respectively; and open chambers that extend between said front part and said rear part and are delimited by at least some internal ribs;

the neck comprises a side wall provided with fixing means for fixing a fingerboard, a bottom wall and a central rib;

the stringed instrument further comprises a metal fingerboard with a compound-radius design machined by CNC from a solid block of rigid non-wood material as a single piece and connected to said unitary structure in a removable and interchangeable manner; said fingerboard comprising connection means arranged in the lateral walls of the same to connect the fingerboard to the neck such that the fingerboard is connected laterally; said connection means being complementary with the fixing means arranged on the neck; and the stringed instrument further comprises a bridge machined by CNC from a solid block of non-wood rigid material and mounted on the front part of the body.

2. The stringed musical instrument according to claim 1, wherein the rigid non-wood material is aluminum.

3. The stringed musical instrument according to claim 1, wherein the stringed musical instrument comprises a plurality of tensioned strings extending between a position anchored in said head and the tail piece.

4. The stringed musical instrument according to claim 1, wherein the stringed musical instrument comprises electronic means mounted on one of said front panels.

5. The stringed musical instrument according to claim 1, wherein the rigid non-wood material of the bridge is aluminum.

6. The stringed musical instrument according to claim 1, wherein the stringed musical instrument comprises a plurality of pickups mounted on one of said front panels and/or connected to the unitary structure through projections.

7. The stringed musical instrument according to claim 1, wherein the stringed musical instrument comprises a touch screen on the front part of the body.

8. The stringed musical instrument according to claim 1, wherein the stringed musical instrument comprises a lighting element housed in hollow cavities of the neck and the head and visible through light ports.

9. The stringed musical instrument according to claim 8, wherein the lighting element is a plurality of optical fibers or resins connected to light emitting diodes.

10. The stringed musical instrument according to claim 1, wherein the fingerboard comprises:

a front surface with a compound radius having combinations within a compound radius of 5 to 30 inches;

an associated set of frets integrally configured with said front surface, said set of frets comprising a zero-fret; and a zero-fret guide.

11. The stringed musical instrument according to claim 1, wherein the fingerboard is CNC machined from a solid block of aluminum.

12. The stringed musical instrument according to claim 1, wherein the connection means are of the magnet-type.

13. The stringed musical instrument according to claim 1, wherein the front surface of the fingerboard is unfretted.

* * * * *